United States Patent [19]

Mayerhofer

[11] Patent Number: 4,615,083

[45] Date of Patent: Oct. 7, 1986

[54] LOCKING SLIDER FOR SLIDE FASTENER AND METHOD OF PRODUCTION THEREOF

[75] Inventor: Friedrich Mayerhofer, Lengnau, Switzerland

[73] Assignee: Speedomatic AG, Lengnau, Switzerland

[21] Appl. No.: 744,231

[22] Filed: Jun. 13, 1985

[30] Foreign Application Priority Data

Jun. 29, 1984 [EP] European Pat. Off. ..... 84810324

[51] Int. Cl.[4] ..... A44B 19/30

[52] U.S. Cl. ..... 24/418; 24/419; 24/420

[58] Field of Search ..... 24/418, 419, 420, 427, 24/428, 297

[56] References Cited

U.S. PATENT DOCUMENTS

| | | | |
|---|---|---|---|
| 2,286,373 | 6/1942 | Rabinow | 24/419 |
| 2,463,074 | 3/1949 | Weber | 24/420 |
| 3,028,647 | 4/1962 | Greenberg | 24/420 |
| 3,210,820 | 10/1965 | Humiston | 24/598 |
| 3,355,778 | 12/1967 | Elsenheimer . | |
| 3,376,617 | 4/1968 | Snyder | 24/419 |
| 4,176,428 | 12/1979 | Kimura | 24/297 |

FOREIGN PATENT DOCUMENTS

| | | | |
|---|---|---|---|
| 683948 | 11/1939 | Fed. Rep. of Germany | 24/420 |
| 1811663 | 2/1976 | Fed. Rep. of Germany . | |
| 2303497 | 3/1975 | France . | |
| 598780 | 5/1978 | Switzerland | 24/419 |
| 641383 | 8/1950 | United Kingdom . | |
| 993275 | 5/1965 | United Kingdom . | |
| 1377451 | 1/1973 | United Kingdom . | |
| 1574079 | 10/1977 | United Kingdom . | |

*Primary Examiner*—Victor N. Sakran

*Attorney, Agent, or Firm*—Wender Murase & White

[57] ABSTRACT

A locking slider for a slide fastener is made entirely of plastics material and comprises a slider body with a springable locking means and a pull tab fastened at a bow of the slider body, the slider body being an integral unit consisting of a lower and an upper slider plate connected by a connecting separator. The upper slider plate comprises a V-shaped bearing for receiving a fastening eyelet at one end of a pull tab. The bow, extending over the bearing, is integrally formed with the locking means and is provided with a fastening pin, which is snapped into a hole in the connecting separator.

The end of said bow provided with locking means is formed as elbow reaching around the free end of the upper slider plate and ending into an upwardly directed barb engaging an opening at the upper slider plate.

The slider as well as the interlocking members of the slide fastener can be produced with the same material having a uniform color. The design of the slider with the integrally formed slider body and the integrally formed springable bow with locking means, allows for production with inexpensive moulds and for easy assembly of the parts.

9 Claims, 3 Drawing Figures

LOCKING SLIDER FOR SLIDE FASTENER AND METHOD OF PRODUCTION THEREOF

BACKGROUND OF THE INVENTION

The present invention refers to a locking slider for a slide fastener and more particularly to a slide fastener, made entirely of plastics material and comprising a slider body with springable lock and a pull tab fastened at a bow at the slider body. The slider body is preferably an integral unit consisting of a lower and an upper slider plate being connected by a connecting separator. The present invention further relates to a method for producing such a slider.

A prior art locking slider is described in German Publication No. 1,811,663. The bow, which is integrally formed with the slider body, is open at one end for assembling the pull tab and the other end is provided with two incisions, producing a springable middle section acting as locking tooth which locks, through an opening in the body, with the interlocking members. The production of such a slider with an integrally formed body with lug and springable locking means necessitates a very complicated and expensive mould. Furthermore, due to the open-ended lug it is possible for the pull tab to be lifted off.

British Pat. No. 1,574,079 discloses a locking slider with a body made of two parts and a springable locking means forming a third part which has to be assembled, together with the pull tab. Furthermore, the pull tab is loosely enclosed in the lug so that for unlocking the slider the whole springable locking means has to be pulled up, ,causing a problem in terms of the strength of the lug.

British Pat. No. 1,377,451 discloses a locking slider having a body which can be produced integrally if an opening is provided in it for introducing a full-elliptic spring as locking means. Otherwise the body must be made in two parts. The mould for the body as well the spring are complicated and expensive parts.

French Publication No. 2,303,497 discloses a locking slider in which the body, lug and locking means are made integrally of plastics material. Theoretically, such a slider should be simpler than the above mentioned prior art. However, in practice the injection of such an integrally formed body with the lug and locking means is very problematic, leading to expensive and complicated moulds. The locking means, in the form of an arm, protrude from the body and the pull tab is freely mounted in the lug, causing problems with regard to the relative rigidity and springability of the arm.

SUMMARY OF THE INVENTION

It is, therefore, the object of the present invention to provide a locking slider made entirely of plastics material, with all advantages inherent with such sliders such as using the same material with the same color for all parts of the slide fastener and preserving the same color after extensive use, however, without the abovementioned drawbacks, in particular, without the need for expensive and complicated moulds, and which can easily be assembled.

These and other objects are attained by providing a locking slider for a slide fastener, made entirely of plastics material and comprising a slider body having a springable locking means and a pull tab fastened at a bow at the slider body. The slider body is preferably an integral unit consisting of a lower and an upper slider plate connected by a connecting separator, wherein the upper slider plate comprises a bearing for receiving an end of the pull tab. The bow, which extends over the bearing, is integrally formed with the locking means and is provided with a fastening pin, the fastening pin being snapped in a hole in the connecting separator.

DESCRIPTION OF THE PREFERRED EMBODIMENTS

Figure 1:
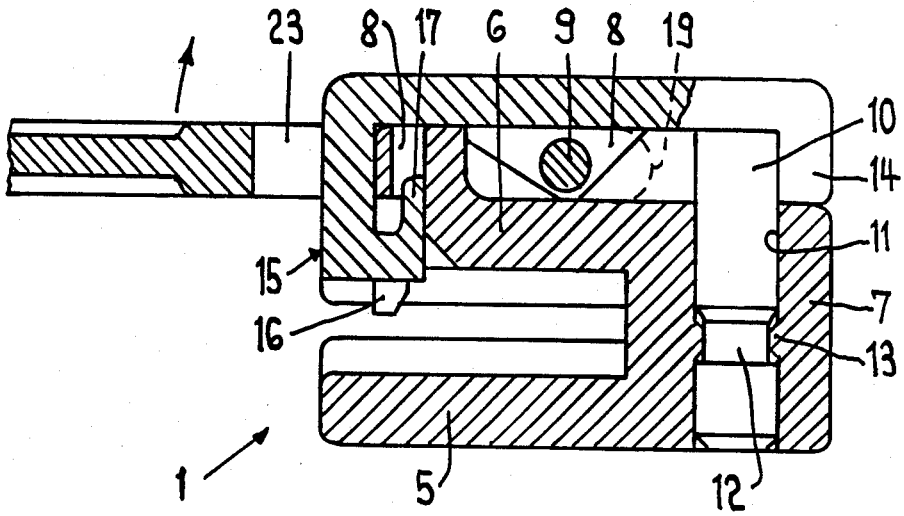
FIG. 1 is a section of a slider according to the invention.
Figure 2:
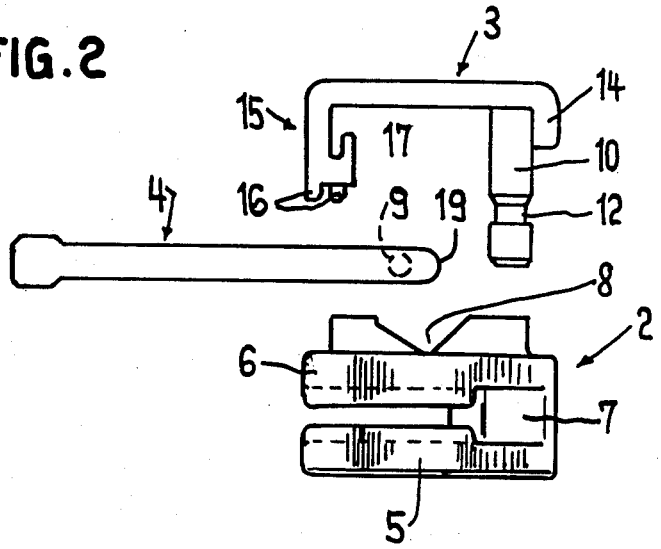
FIG. 2 is a lateral view of the individual elements of the slider according to the invention.

In FIG. 2 of the drawings there is shown the different elements of which the slider 1 is constricted, namely a slider body 2, made as integral part, a springable bow 3, and a pull tab 4. All parts of the slider are made of injected plastics material. The slider body 2 consists of a lower slider plate 5 which is connected by a connecting separator 7 with an upper slider plate 6. On top of the upper slider plate 6 there is a V-shaped bearing 8 for receiving an end of the pull tab 4 which is formed as fastening eyelet 23 (See FIG. 1) with a cross link 9 resting in the channel of the V-shaped bearing 8.

The bow 3 comprises at one end a fastening pin 10, which snaps into a hole 11 in connecting separator 7 of the slider body. For better hold, the fastening pin is provided with a circular indentation 12, into which a corresponding enlargement 13 in the hole extends. The upper side of the bow extends around the fastening pin, the bend shank 14 serving as reinforcement and as abutment when the bow is springing. The bow extends over the bearing 8 and encloses the pull tab, 4 and its cross link 9 completely, as shown in FIG. 1.

The other end of the bow 3 is formed as an elbow 15, having a lower end which comprises a locking means in the form of two teeth 16 and, at the inside, an upwardly directed barb 17 which reaches into an appropriate opening 18 in the slider body to prevent the bow from being raised at this end. The two teeth 16 are arranged on either sides of and offset with reference to the longitudinal axis of the slider body for reaching between two interlocking members of the fastener stringers for locking the slider.

The cross link 9 is disposed near but not at the end of the pull tab, resulting in two endpieces 19 (See FIG. 3) resting on either side of the V-shaped bearing 8 on the upper slider plate 6. By turning the pull tab in direction of the arrow (FIG. 1) both endpieces prop on the upper slider plate and the cross link 9 acts upon the springable bow 3 from below, raising it. Thereby only the free end, that is the end with the elbow 15 and the locking means, is raised. This results in a canted position of the pull tab, that is turned from the position shown in the drawings whereby by 180°, whereby the locking means is no longer engaged with the interlocking members and the slider is, therefore, freely movable.

For larger-scaled embodiments the middle section can be formed differently and the locking means can comprise only one locking tooth and the barb can be formed as step, reaching behind a corresponding step provided at the upper slider plate.

Althought the above described slider is particularly well suited for interlocking members made of plastics material, they can also be used for interlocking members made of metal. For use with spiral slide fasteners made of Nylon® some modifications of the slider are necessary. The lower slider plate is made flat and the locking means can be passed through the upper slider plate. In this case the end of the bow should have retaining means preventing the lift-off of the bow.

Figure 3:
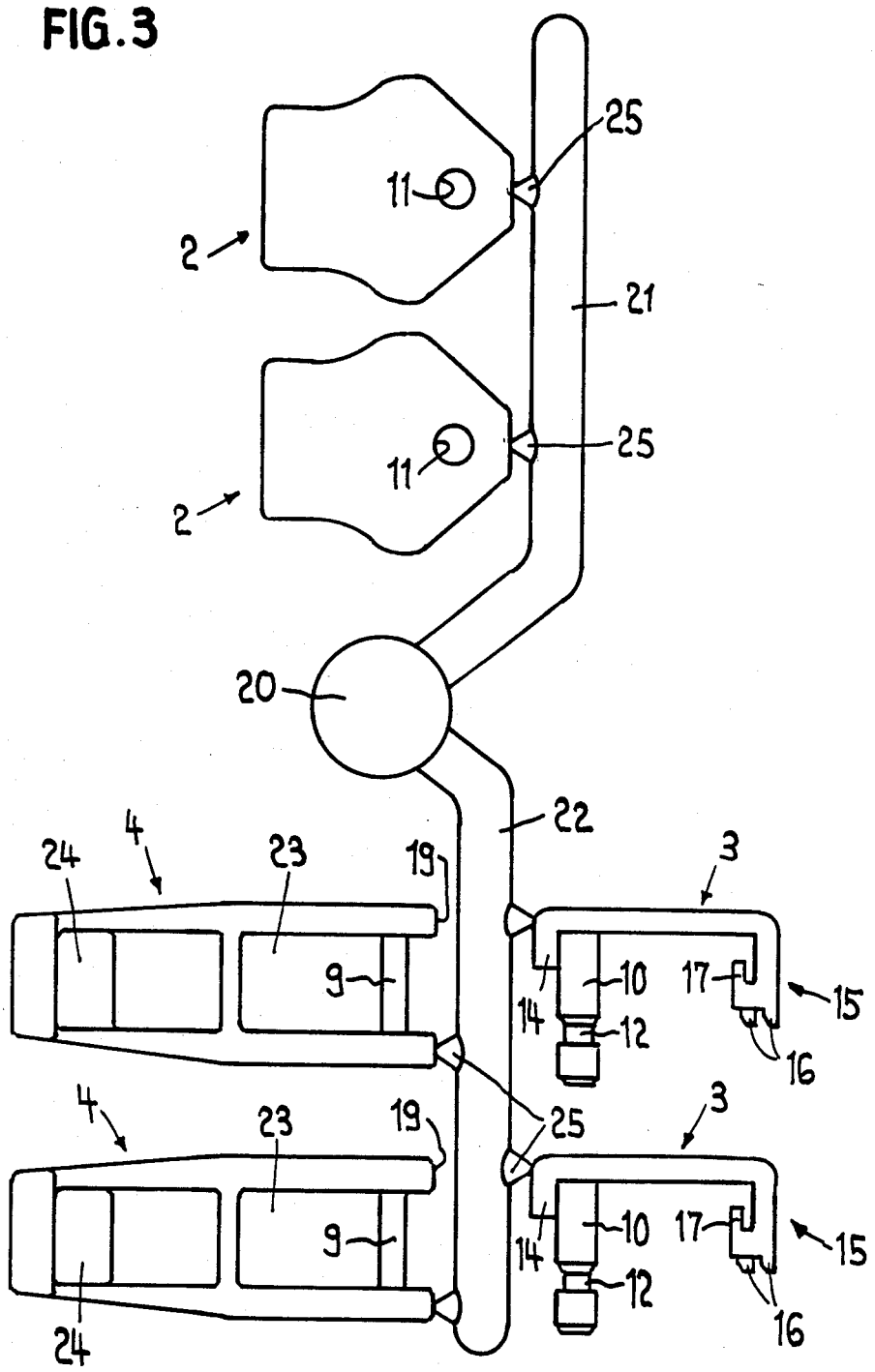
FIG. 3 is a plane view of the elements of the slider from a mould.

In FIG. 3 there is shown injected pieces as taken out of the injection mould. It can be seen that an equal quantity of each of the elements constituting the slider are injected, thereby ensuring that all elements are made of identical material. It follows from FIG. 3 that the material flows from the center tube 20 through a first feeding pipe 21 to the mould portion for the two slider bodies and through a second feeding pipe 22 to the mould portion where on one side two pull tabs and on the other side two bows are arranged, whereby all parts are injected simultaneously. The feeding pipes 25 to the individual parts have indentations at which the parts may be easily separated from the pipe 22.

It can also be seen that pull tabs have at the one end, the eyelet 23 ending at the cross link 9, and at the other end an opening 24, for easier handling.

It is within the scope of the present invention that instead of two pieces of each the slider elements, other quantities can be moulded simultaneously. Advantageously the interlocking members are injection moulded of the same material. Preferably, the injection of the interlocking members and the slider, the cutting, the assembling of the end members of the fastener stringers and the introduction of the slider is be automated, and the production of the whole slide fastener is effectuated on an assembly line.

What I claim:

1. A locking slider for slide fastener formed of a plastic material and comprising:

a single piece slider body, a springable bow including a locking means, and a pull tab fastened by said bow to the slider body, said slider body comprising a lower and an upper slider plate connected by a connecting separator having a hole, said upper slider plate including a bearing for receiving an end of said pull tab, wherein said bow extends over said bearing, is integrally formed with said locking means and includes a fastening pin, said fastening pin being snap retained in the hole in said connecting separator.

2. A locking slider according to claim 1, wherein said locking means is formed at an end of said bow, said end including and elbow extending to a free end of the upper slider plate and terminating at an upwardly directed locking member operable to engage a complimentary member of the upper slider plate.

3. A locking slider according to claim 1, wherein the locking member comprises a pair of teeth, one arranged on either side of and offset with respect to a longitudinal axis of the slider body.

4. A locking slider according to claim 1 for use with a spiral slide fastener, wherein the lower slider plate is flat.

5. A locking slider according to claim 1, wherein said locking means is disposed at an end of said bow and extends through the upper slider plate and wherein said end of the bow includes an abutment means for engaging the upper slider plate.

6. A locking slider according to claim 1, wherein said fastening pin includes a circular indentation and said hole in the connecting separator includes with a corresponding enlargement for engaging said indentation.

7. A locking slider according to claim 1, wherein said bearing on the upper slider plate is V-shaped and has a width smaller than the width of said upper slider plate.

8. A locking slider according to claim 7, wherein said pull tab includes a fastening eyelet terminating at a cross link resting on the V-shaped bearing, said cross link being spaced from the end of said pull tab for forming two end pieces resting on either sides of said V-shaped bearing, said end pieces being operable, when said pull tab is rotated, to raise the end of the bow with the locking means.

9. A method for producing a locking slider for a slide fastener formed of a plastic material and comprising a single piece slider body, a springable bow and a pull tab fastened by the bow to the slider body, said method comprising the steps of:

injection moulding equal quantities of single piece slider bodies, single piece bows and single piece pull tabs, said step of moulding further comprising:

feeding plastic material from a center tube through a first feeding pipe for moulding said slider bodies and through a second feeding pipe for moulding said springable bow, said pull tabs, removing said slider bodies, springable bows and pull tabs from said feeding pipes;

assembling said locking slider from the parts moulded from the same center tube to insure color uniformity.

* * * * *